United States Patent [19]

Brooks et al.

[11] Patent Number: 4,550,068

[45] Date of Patent: Oct. 29, 1985

[54] VERTICAL MAGNETIC BRUSH DEVELOPING APPARATUS AND METHOD

[75] Inventors: Jeffrey B. Brooks; Warren M. Larson, both of Keene, N.H.

[73] Assignee: Markem Corporation, Keene, N.H.

[21] Appl. No.: 574,856

[22] Filed: Jan. 30, 1984

[51] Int. Cl.[4] ..... G03G 15/09

[52] U.S. Cl. ..... 430/122; 118/657

[58] Field of Search ..... 118/658, 657; 430/122

[56] References Cited

U.S. PATENT DOCUMENTS

| | | | |
|---|---|---|---|
| 2,786,439 | 3/1957 | Young | 118/657 |
| 2,832,311 | 4/1958 | Byrne | 118/657 |
| 3,015,305 | 1/1962 | Hall et al. | 118/658 |
| 3,098,765 | 7/1963 | Keller et al. | 118/652 |
| 3,113,042 | 12/1963 | Hall | 118/657 |
| 3,196,831 | 7/1965 | Sugarman, Jr. | 118/652 |
| 3,306,193 | 2/1967 | Rarey et al. | 101/114 |
| 3,358,594 | 12/1967 | Thompson | 101/114 |
| 3,437,074 | 4/1969 | Hagopian et al. | 118/623 |
| 3,557,751 | 1/1971 | Kushima et al. | 118/657 |
| 3,572,922 | 3/1971 | Olden | 355/3 DD |
| 3,621,779 | 11/1971 | Carl et al. | 101/366 |
| 3,633,545 | 1/1972 | Samaniego . | |
| 3,640,247 | 2/1972 | Mason et al. | 118/657 |
| 3,643,311 | 2/1972 | Knechtel et al. | 430/122 |
| 3,664,299 | 5/1972 | Shaler et al. | 118/652 |
| 3,759,367 | 9/1973 | Elliott | 198/619 |
| 3,777,707 | 12/1973 | Hodges | 355/3 DD |
| 3,834,350 | 9/1974 | Hodges . | |
| 3,952,857 | 4/1976 | Nazuka | 198/661 |
| 4,051,484 | 9/1977 | Martin | 346/74.2 |
| 4,067,296 | 1/1978 | Sessink | 118/658 |
| 4,139,296 | 2/1979 | Ruckdeschel | 355/3 DD |
| 4,155,328 | 5/1979 | Navone | 118/657 |
| 4,155,329 | 5/1979 | Tsukamoto et al. | 118/658 |
| 4,170,287 | 10/1979 | Edwards et al. | 198/657 |
| 4,185,130 | 1/1980 | Edwards et al. | 427/47 |
| 4,230,069 | 10/1980 | Aldea et al. . | |
| 4,252,434 | 2/1981 | Nakamura et al. | 355/15 |
| 4,254,203 | 3/1981 | Oka et al. | 430/120 |
| 4,282,303 | 8/1981 | Bergen | 430/120 |
| 4,297,969 | 11/1981 | Torigai | 118/652 |
| 4,304,192 | 12/1981 | Mayer | 118/653 |
| 4,318,606 | 3/1982 | Buholtz et al. | 355/3 DD |

FOREIGN PATENT DOCUMENTS

| | | |
|---|---|---|
| 55-41436 | 3/1980 | Japan . |
| 1066831 | 4/1967 | United Kingdom . |

*Primary Examiner*—John L. Goodrow

*Attorney, Agent, or Firm*—Robbins & Laramie

[57] ABSTRACT

A magnetic brush developing apparatus is described which comprises a vertically positioned magnetic supply roll, a similarly positioned magnetic developer roll, and supply means such as a hopper for supplying magnetically attractable developer particles to the lower portion of the supply roll. The supply roll is provided with a magnetization pattern in which the magnetic poles are arranged in helical bands with respect to the roll axis. The developer roll has a symmetric magnetization pattern in which the magnetic poles are arranged in straight linear bands parallel to the roll axis. Developer particles move circumferentially and vertically upward on the surface of the supply roll and are transferred to the surface of the developer roll across a narrow vertical gap separating the two rolls. A doctor blade associated with the supply roll returns excess developer from the supply roll to the hopper. A second doctor blade associated with the developer roll, and positioned in proximity to the gap separating the supply roll from the developer roll, removes excess developer from the developer roll and allows the developer so removed to be magnetically attracted back to the supply roll. The developer is thus continually recirculated between the supply roll and developer roll, and between the supply roll and the supply hopper, with the net amount of developer removed from the hopper being equal to the amount transferred to the recording medium by the developer roll.

14 Claims, 10 Drawing Figures

VERTICAL MAGNETIC BRUSH DEVELOPING APPARATUS AND METHOD

BACKGROUND OF THE INVENTION

1. Field of the Invention

The present invention relates generally to an apparatus and method for developing latent electrostatic or magnetic images, and is particularly concerned with an apparatus and method for carrying out magnetic brush development of latent images on vertically presented recording surfaces.

2. Description of the Prior Art

In conventional xerographic and electrostatic recording processes, a latent charge image is formed on a recording surface and is then developed into a visible image by applying a pigmented developer material. The recording surface may consist, for example, of a photoconductive layer which is initially provided with a uniform electrostatic charge. The photoconductive layer is then selectively discharged in an imagewise manner by exposing the recording layer to a light pattern corresponding to the image to be reproduced. This produces a latent electrostatic image to which oppositely charged developer particles will adhere. The developed image can be fixed or rendered permanent in various ways, such as by applying heat, pressure, solvents, and combinations of these.

The foregoing is essentially an optical image reproduction process, and is employed in most types of commercially available document photocopying machines. The photoconductive layer may be provided on the final recording medium, as in the case of coated paper xerography, or it may be provided on the surface of an intermediate transfer member such as a rotary drum. The latter arrangement is employed in xerographic copiers of the plain paper type.

Electrostatic printing techniques have also been developed in which latent charge images are created non-optically on a dielectric charge retentive surface by means of an electrostatic print head, which is typically of the dot matrix type. The dielectric layer, like the photoconductive layer in optical copiers, may be provided either on the final recording medium or on an intermediate transfer member. In non-optical electrostatic printing systems, however, the dielectric layer is not required to be light-sensitive.

Various methods have been employed for developing (i.e., rendering visible) the latent charge images created by xerographic and electrostatic imaging techniques. One early developing method involved cascading the developer material across the latent image areas to be developed. Another method, referred to as powder cloud development, involved dispersing the developer particles in a moving stream or flow of air and then bringing the entrained particles into contact with the latent image bearing surface. Rotating fur brushes were also used to apply the developer particles to the recording surface in some early types of xerographic and electrostatic imaging apparatus.

A more common developing method at the present time is referred to as magnetic brush development. This involves the use of a magnetic element, typically in the form of a cylindrical roll, for carrying the developer material and applying it to the latent image bearing surface. The developer material may be of the two-component type, in which finely divided and pigmented toner powder is interspersed with somewhat larger ferromagnetic carrier particles. Alternatively, the developer material may be of the single-component type, in which only one kind of particle is involved. A common type of single-component developer consists of fine particles of magnetic material, such as iron or iron oxide, encapsulated within a resin having a relatively low softening temperature. A suitable pigment such as carbon black is usually added to the resin in order to impart the desired color to the developer material.

When placed in a magnetic field, a developer material of either the two-component or single-component type will form streamers resembling the bristles of a brush, similar to the way in which iron filings will align themselves with the magnetic flux lines at the ends of a bar magnet. This property is exploited in magnetic brush developing systems by utilizing a magnetic roll assembly to retain a brush-like layer of developer material on its peripheral surface. The layer of developer is brought into light brushing contact with the latent image bearing surface, which is usually moving in a direction normal to the roll axis as the roll itself rotates. The brushing action brings the developer material into intimate contact with the recording surface and permits electrostatic transfer of the developer particles from the roll to the latent image areas.

A number of different structural configurations have been employed in magnetic brush developing systems. The simplest arrangement is an exposed magnetic roll which carries a layer of developer material on its peripheral surface. The roll may be magnetized in various ways, either intrinsically or by covering the peripheral surface of the roll with a magnetic material. An alternative arrangement, more widely used at the present time, is a two-part roll assembly consisting of an inner magnetic element enclosed within an outer non-magnetic shell or sleeve. The shell is usually cylindrical in shape and provides a smooth carrier surface over which the developer particles can slide while being held by the inner magnetic element. The magnetic flux density at the shell surface will be a function of the spacing between the shell and the inner magnetic element, and of the magnetic permeability of the shell material. Hence by appropriate selection of these factors, it is possible to obtain close control over the magnetic field strength that is used to hold the developer particles on the surface of the shell. Another advantage of the shell is that it provides a useful barrier against contamination of the inner magnetic element and any associated bearings, shafts, and the like with developer particles.

Various types of two-part magnetic brush rolls have been proposed. In one form of the device, the inner magnetic element rotates while the outer shell is held stationary. The rotation of the inner magnetic element causes a backward tumbling or somersaulting motion of the developer particles on the outside circumference of the shell, resulting in a net propagation of the developer material in the direction opposite to the rotational direction of the inner magnetic element. The propagation rate of the developer particles is much less than the rotational speed of the inner magnetic element, but is sufficient to assure a continuous flow of developer particles to the developing zone. In another form of the device, the outer shell rotates with respect to the inner magnetic element which is held stationary. This embodiment is usually used with two-component developers, since the rotation of the outer shell induces thorough mixing between the toner and carrier particles and continuous replacement of spent developer (i.e., denuded carrier particles) at the developing zone.

In embodiments wherein a rotatable shell is employed, it is possible to control the rate of movement of the developer material by varying the rotational speed of the shell. Hence it is possible to deliver more developer material to the developing zone by increasing the rotational speed of the shell, and conversely, less developer material is carried to the developing zone when the shell speed is reduced. In fixed-shell embodiments, a similar but less pronounced effect can be obtained by varying the speed of the inner magnetic element.

In some arrangements, a second magnetic roll, referred to as a supply roll, is positioned between the main developing roll and a source or reservoir of developer particles. The supply roll delivers a metered amount of developer material to the main roll and provides further mixing or agitation of the developer particles.

In the design of magnetic brush developing systems, it is conventional to mount the magnetic brush roll horizontally, that is, with its axis of rotation oriented in a horizontal direction. Such mounting of the magnetic brush roll may be dictated by the path of movement of the recording medium and by other factors as well. For example, it is a relatively simple matter to supply developer particles in a uniform manner to a horizontally positioned magnetic brush roll, as by partially immersing the magnetic brush roll (or an associated supply roll) in a horizontal bed or trough of developer particles. This would not be feasible with a non-horizontal roll. Horizontal positioning of the magnetic brush roll also insures that a uniform layer of developer particles is maintained on the outside surface of the roll. A non-horizontal roll, on the other hand, would be subject to gravity-induced creep of the developer particles in a downward direction along the axial length of the roll.

In most instances, a horizontally positioned magnetic brush roll is entirely acceptable and may in fact be required by the path of movement of the recording surface to which the developer material must be applied. In this connection, it is usually desirable to position the magnetic brush roll with its axis of rotation transverse to the direction of movement of the recording surface, so that the layer of developer material is brushed uniformly across the width of the recording surface. It follows that a horizontally positioned magnetic brush roll is capable of developing a recording surface only when the recording surface has its lateral or transverse dimension (i.e., the dimension perpendicular to its direction of movement) extending in a horizontal direction. In some applications, however, it is desirable to orient the recording surface so that its lateral or transverse dimension extends in a vertical direction. This might occur, for example, when the recording medium comprises a paper web which is held in a vertical plane and moved in a horizontal direction. An equivalent situation occurs in the case of a drum-type recording member when the drum has its axis of rotation disposed vertically. In these instances, it is not feasible to employ a horizontally positioned magnetic brush roll to develop the latent images on the recording surface.

In U.S. Pat. No. 3,777,707, to Robert James Hodges, a magnetic powder handling arrangement is described which is said to be capable of applying magnetic powder to a latent image formed on a vertically held surface. The disclosed apparatus consists of a roller having its axis vertical, with a curved shield embracing the roller. The outside surface of the roller and the inside surface of the curved shield are each faced with a sheet of magnetic rubber which is magnetized in strips. In the case of the roller, the strips extend parallel to the axis of rotation, while in the case of the curved shield the strips are arranged helically. The lower ends of the roller and shield are both immersed in a reservoir of magnetic powder. Rotation of the roller within the curved shield causes the powder to be drawn upward within the annular gap which exists between the outside surface of the roller and the inside surface of the shield, due to the interaction between the parallel magnetic strips on the roller and the intersecting helical magnetic strips on the shield. A vertical gap is provided in the curved shield in order to allow the powder layer on the inner roller to make contact with a vertically held surface on which a latent image has been formed.

Although the arrangement described in U.S. Pat. No. 3,777,707 is theoretically capable of applying magnetic developer particles to a vertically held surface, several practical problems with this device are immediately apparent. For example, since powder is supplied only to the lower part of the roller, the effect of gravity is likely to cause the powder layer to be thicker at the bottom of the roller than at the top, despite the lifting effect of the intersecting magnetic strips. It is also apparent that the thickness of the powder layer on the inner roller will inherently be fixed by the size of the gap between the inner roller and the outer shield, and will not be capable of adjustment except by modifying the overall dimensions of the device. If the gap is made too small, the movement of the powder between the roller and shield may be impeded. If the gap is made too large, the necessary interaction between the magnetic strips on the outer surface of the roller and the intersecting strips on the inner surface of the shield may be reduced to a point where the powder is no longer drawn upwardly. Another problem with the device is that no provision is made for limiting the amount of magnetic powder which is drawn upward between the inner roller and outer shell. Therefore, to the extent that the amount of powder which is transported upward exceeds the amount transferred to the latent image bearing surface, the excess powder would theoretically overflow the top of the device. Finally, the Hodges apparatus places the magnetic powder in direct contact with the magnetic strips on the inner roller and the outer shield, and the device therefore lacks the advantages associated with other types of magnetic brush developing apparatus in which the developer layer is carried by a separate non-magnetic shell in surrounding relationship with the inner magnetic element.

Although the foregoing discussion has been concerned primarily with the development of latent electrostatic images, it should be pointed out that similar considerations apply to magnetic imaging systems as well. Magnetic imaging can be carried out by magnetizing selected areas of a layer of magnetic material using a magnetic recording head. Alternatively, imaging can be accomplished by imparting uniform magnetization to a layer of magnetic material, and then selectively demagnetizing the material in an imagewise pattern by raising the temperature of selected areas above the Curie point of the material (e.g., by a flash exposure). Both methods leave the layer of material with a latent magnetic image which can be rendered visible by the application of a magnetically attractable developer material. Magnetic brush developers can be used for this purpose, as long as steps are taken to avoid distortion of the magnetic image by the magnetic field produced by the developer roll.

SUMMARY OF THE INVENTION

The present invention provides a magnetic brush developing apparatus which is capable of developing latent electrostatic or magnetic images on vertically presented recording surfaces, while at the same time avoiding the limitations and disadvantages of the prior art. The invention also embraces a method for developing latent electrostatic and magnetic images on vertically presented surfaces, which method is carried out by the exemplary apparatus disclosed and claimed herein.

In accordance with the apparatus aspects of the invention, a magnetic brush developing apparatus comprises a vertically positioned magnetic supply roll and a similarly positioned magnetic developer roll. The developer roll is separated from the supply roll by a narrow vertical gap. The supply roll has a magnetization pattern in which the magnetic poles are arranged in helical bands with respect to the roll axis. The developer roll, on the other hand, has a magnetization pattern in which the magnetic poles are arranged in straight linear bands parallel to the axis of the developer roll. Means are provided for supplying magnetically attractable developer particles to the lower portion of the supply roll.

In operation, rotation of the supply roll will cause the developer particles supplied to the lower portion thereof to move both circumferentially and vertically upward along the supply roll, thereby forming a substantially continuous layer of developer particles on the outside surface of the supply roll. With the developer roll positioned sufficiently close to the supply roll, and having a magnetic field strength sufficiently greater than that of the supply roll, some of the developer particles on the supply roll will transfer to the surface of the developer roll. The developer particles so transferred are caused to move circumferentially around the developer roll in a substantially continuous layer in response to rotation of the developer roll. The developer layer on the developer roll can be brought into light brushing contact with a vertically presented recording surface in order to develop a latent electrostatic or magnetic image thereon. By way of example, the recording surface may comprise a continuous web supported in a vertical plane but moving horizontally, or a rotary drum having its axis of rotation disposed vertically, or any other equivalent arrangement.

In a preferred embodiment of the invention, the supply roll and developer roll each comprise an inner rotatably mounted magnetic element with a permanent magnetization pattern, and an outer non-magnetic shell surrounding the inner magnetic element. The outer non-magnetic shells of the supply roll and the developer roll are preferably fixed, but may be made rotatable if desired. The developer material is preferably delivered to the supply roll from a hopper having an outlet communicating with the lower portion of the supply roll.

A supply roll doctor blade may be positioned adjacent to the supply roll, with the doctor blade forming a narrow gap with respect to the fixed outer shell of the supply roll in order to maintain a regulated layer of developer material thereon of a maximum predetermined thickness. Advantageously, the supply roll doctor blade is positioned in substantial alignment with the hopper outlet so that excess developer particles which are removed from the supply roll are returned by gravity to the hopper. The supply roll doctor blade may terminate in an upper stepped portion which is in actual contact with the upper part of the supply roll shell, with the stepped portion serving as a decoupling element for removing essentially all developer particles from the upper part of the supply roll. The developer particles so removed are also returned by gravity to the supply hopper.

A second doctor blade may be positioned adjacent to the developer roll in order to maintain thereon a regulated layer of developer material having a maximum predetermined thickness. Advantageously, the developer roll doctor blade is positioned in proximity to the gap between the supply roll and the developer roll, so that excess developer which is removed from the developer roll is magnetically attracted back to the supply roll.

The foregoing arrangement provides a simple yet efficient means for achieving magnetic brush development of latent electrostatic or magnetic images on vertically presented recording surfaces. In contrast to the prior art, two separate magnetic rolls are used to achieve vertical development, rather than only one. The helically magnetized supply roll serves to deliver particulate developer from the hopper to the developer roll and also to overcome the gravitational effect that would otherwise confine the developer particles to the lower portion of the developer roll. The helical magnetization pattern of the supply roll causes the developer particles to form a substantially continuous layer on the outside surface of the supply roll in both the circumferential and axial directions, which allows developer material to be presented uniformly to the developer roll along the entire vertical gap between the developer roll and the supply roll. This, in turn, insures that a continuous layer of developer particles is maintained on the outside circumference of the developer roll for subsequent application to the latent image bearing surface to be developed. Hence by providing separate magnetic rolls for the developer elevating function, on one hand, and for the developer applying function, on the other hand, the present invention achieves a more uniform application of developer particles to the recording medium.

The supply roll doctor blade in the present invention insures that only the proper thickness of developer material is maintained on the surface of the supply roll, with excess developer being returned by gravity to the supply hopper. The upper stepped portion of the supply roll doctor blade insures that the developer particles do not advance beyond a predetermined vertical height on the surface of the supply roll. Developer particles which are removed from the upper part of the supply roll by the stepped portion of the supply roll doctor blade are also returned by gravity to the developer supply hopper. The supply roll doctor blade thus completes what is essentially a first developer recirculation loop existing between the supply roll and the hopper, and vice-versa.

In a similar manner, the developer roll doctor blade completes a second developer recirculation loop between the supply roll and the developer roll. Thus, whle developer particles are normally transferred in the direction from the supply roll to the developer roll, the positioning of the developer roll doctor blade in proximity to the gap between the supply roll and the developer roll insures that excess developer which is removed from the developer roll will be magnetically attracted back to the surface of the supply roll.

In sum, taking into account both the first and second developer recirculation loops, there is a continuous flow of developer from the hopper to the supply roll and ultimately to the developer roll, with excess toner eventually being returned to the hopper. When the developer layer on the developer roll is placed in contact with a moving recording surface to develop a latent image thereon, the amount of developer delivered to the recording medium during a given time interval will be equal to the net amount of developer removed from the hopper during the same interval. There is no tendency for an excessive amount of developer material to be delivered to the recording medium in situations where the recording medium moves at a slow rate of speed. Moreover, when there is no recording medium present at all, the developer particles simply recirculate between the hopper and the supply and developer rolls, without any tendency to overflow the top of either roll.

BRIEF DESCRIPTION OF THE DRAWINGS

The various objects, advantages, and novel features of the invention will be more readily apprehended from the following detailed description when read in conjunction with the appended drawings, in which.

Throughout the drawings, like reference numerals will be understood to refer to like parts.

DETAILED DESCRIPTION OF THE PREFERRED EMBODIMENT

Figure 1:
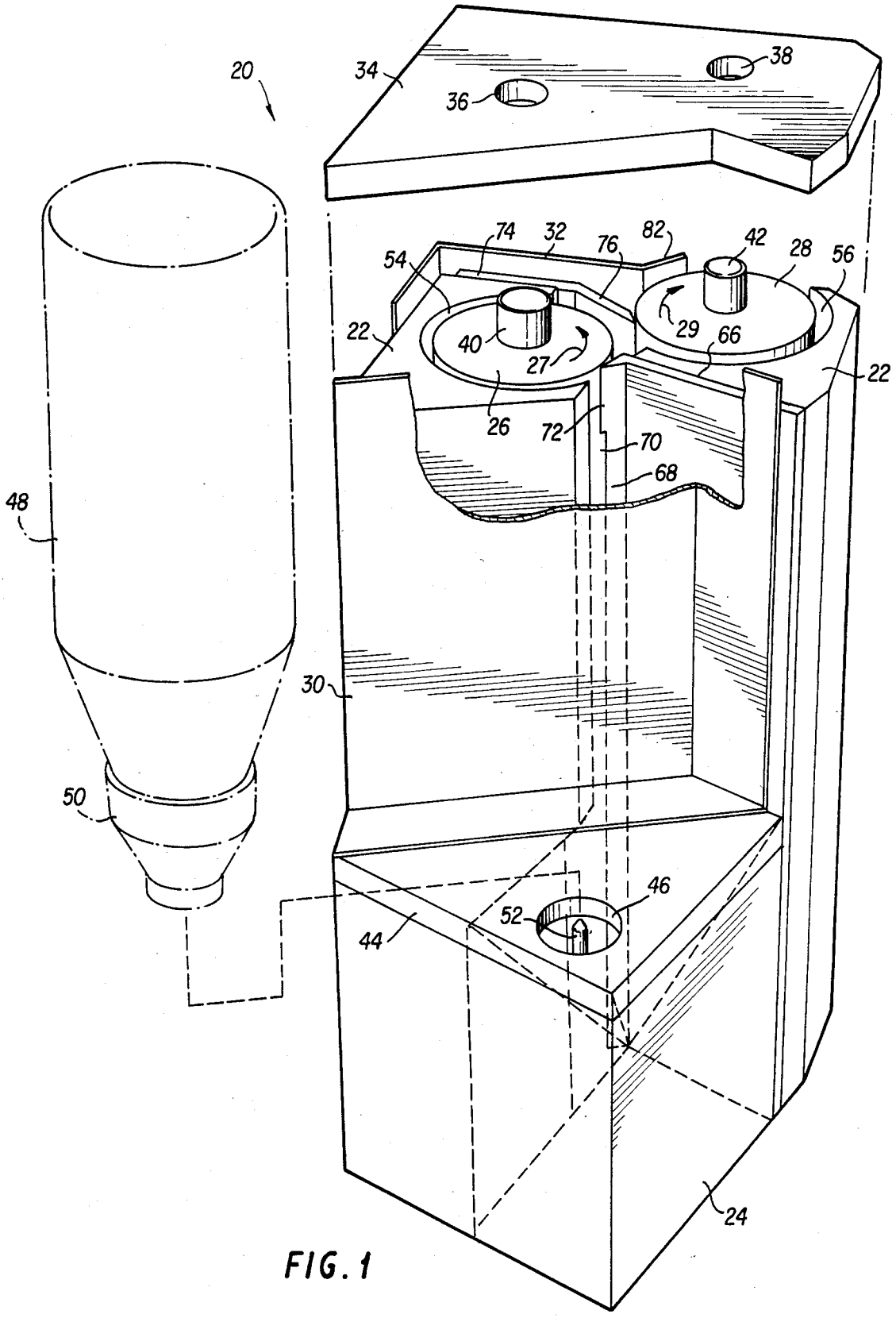
FIG. 1 is a partially exploded perspective view of a vertically positioned magnetic brush developing apparatus constructed in accordance with the present invention, with a portion of the front cover plate cut away to illustrate certain internal details of the apparatus.

In FIG. 1, a magnetic brush developing unit 20 constructed in accordance with the present invention is illustrated in a partially exploded perspective view. In general, the developer unit 20 comprises a housing 22, an attached developer supply hopper 24, and two vertically positioned magnetic rolls 26 and 28 enclosed within the housing 22. The housing 22 is fitted with a front cover 30, shown partially cut away, and a rear cover 32 which also serves as a toner shield. A top cover 34 is also fitted to the housing and is provided with clearance holes 36 and 38 to accommodate the protruding upper bosses 40 and 42 of the supply roll and developer roll, respectively.

The developer supply hopper 24 is fitted with a top cover 44 in which a circular inlet opening 46 is formed. Particulate developer material is supplied to the inlet opening 46 from a developer supply container in the form of a bottle 48, shown in phantom in FIG. 1. The actual size of the bottle 48 is somewhat larger than that shown in FIG. 1, the actual size being more readily apparent from FIG. 4. The developer supply bottle 48 is fitted with a dispenser cap 50, the latter being receivable in the hopper inlet opening 46 for delivering developer material into the interior of the hopper 24. An upstanding spill pin 52 in the hopper operates a movable plunger within the dispenser cap 50 to start the flow of developer when the bottle 48 is installed, as will be described in more detail hereinafter. The developer supply bottle 48 normally remains continually affixed to the hopper 24 when the developer unit 20 is in operation, positioned within the area above the hopper cover 44 and forward of the front cover 30. The bottle 48 is removed and replaced when the supply of developer therein has been depleted.

Figure 2:
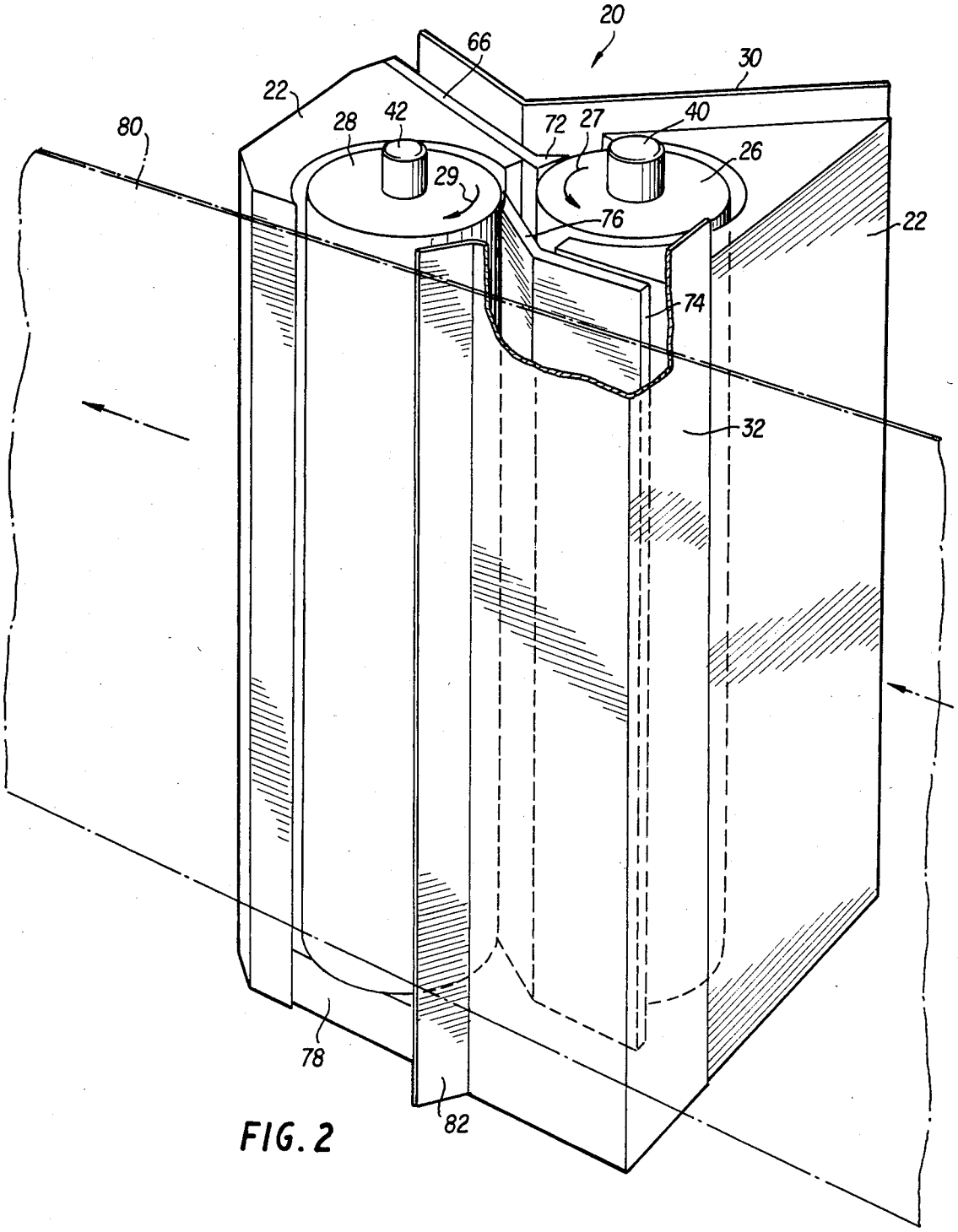
FIG. 2 is a rear perspective view of the magnetic brush developing apparatus, with the developer supply bottle and top housing cover removed, and with a portion of the rear cover plate cut away to reveal certain internal details of the apparatus.
Figure 3:
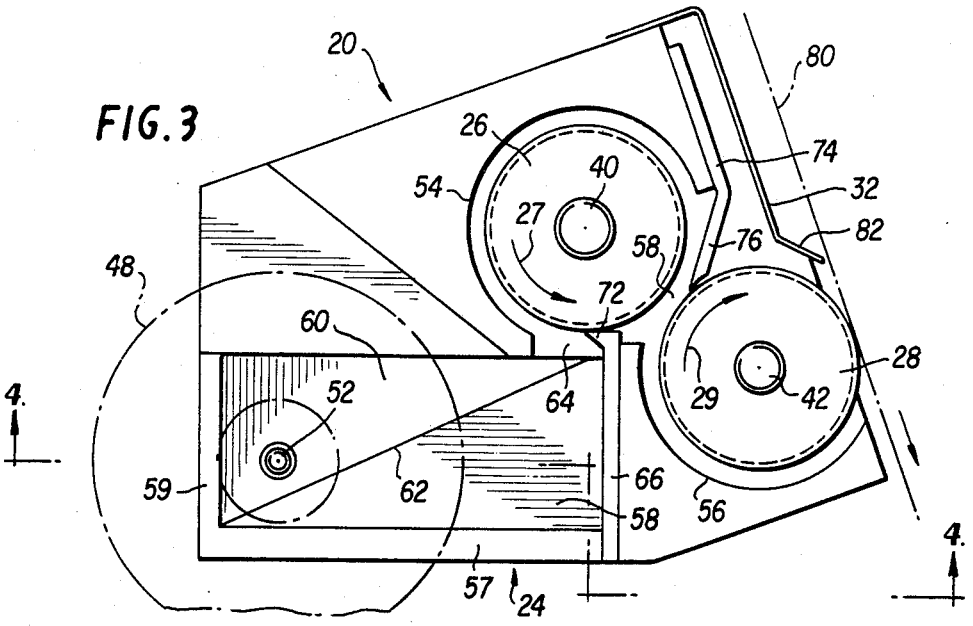
FIG. 3 is a top view of the magnetic brush developing apparatus, with the hopper cover and top housing cover removed, and with the outline of the developer supply container shown in phantom.

As will be apparent from FIGS. 1–3, the developer unit housing 22 is provided with a pair of vertical cylindrical cavities 54 and 56 for receiving and partially enclosing the supply roll 26 and developer roll 28, respectively. The supply roll 26 and developer roll 28 are both positioned with their axes of rotation extending in a substantially vertical direction, as shown. The two rolls 26 and 28 are arranged in side-by-side relationship with a narrow vertical gap 58 separating the peripheral surface of the supply roll 26 from the peripheral surface of the developer roll 28, as best seen in FIG. 3. The size of the gap 58 is about 0.169 inch in the preferred embodiment. As will be described shortly in connection with FIGS. 5 and 6, the supply roll 26 and developer roll 28 each preferably comprise an inner rotatably mounted magnetic element with a permanent magnetization pattern, and a fixed outer non-magnetic shell or sleeve surrounding the magnet element. In the case of the supply roll 26, the magnetization pattern of the inner magnetic element is helical with respect to the roll axis. In the case of the developer roll 28, the magnetic poles of the inner magnetic element are arranged in straight linear bands parallel to the roll axis. It should be understood that, as long as the magnetization patterns are as described, alternative constructions are possible for the supply roll 26 and developer roll 28. Examples of alternative arrangements include a rotatable outer shell with a fixed inner magnetic element, and a rotatable outer shell with a rotating or counter-rotating inner magnetic element. A rotating outer shell will be particularly desirable in situations where it is necessary to deliver developer particles to the developing zone at a greater rate than would be possible by relying on the propagation of developer consequent from the rotation of the inner magnetic element, or when greater agitation or mixing of the developer material is needed.

Figure 4:
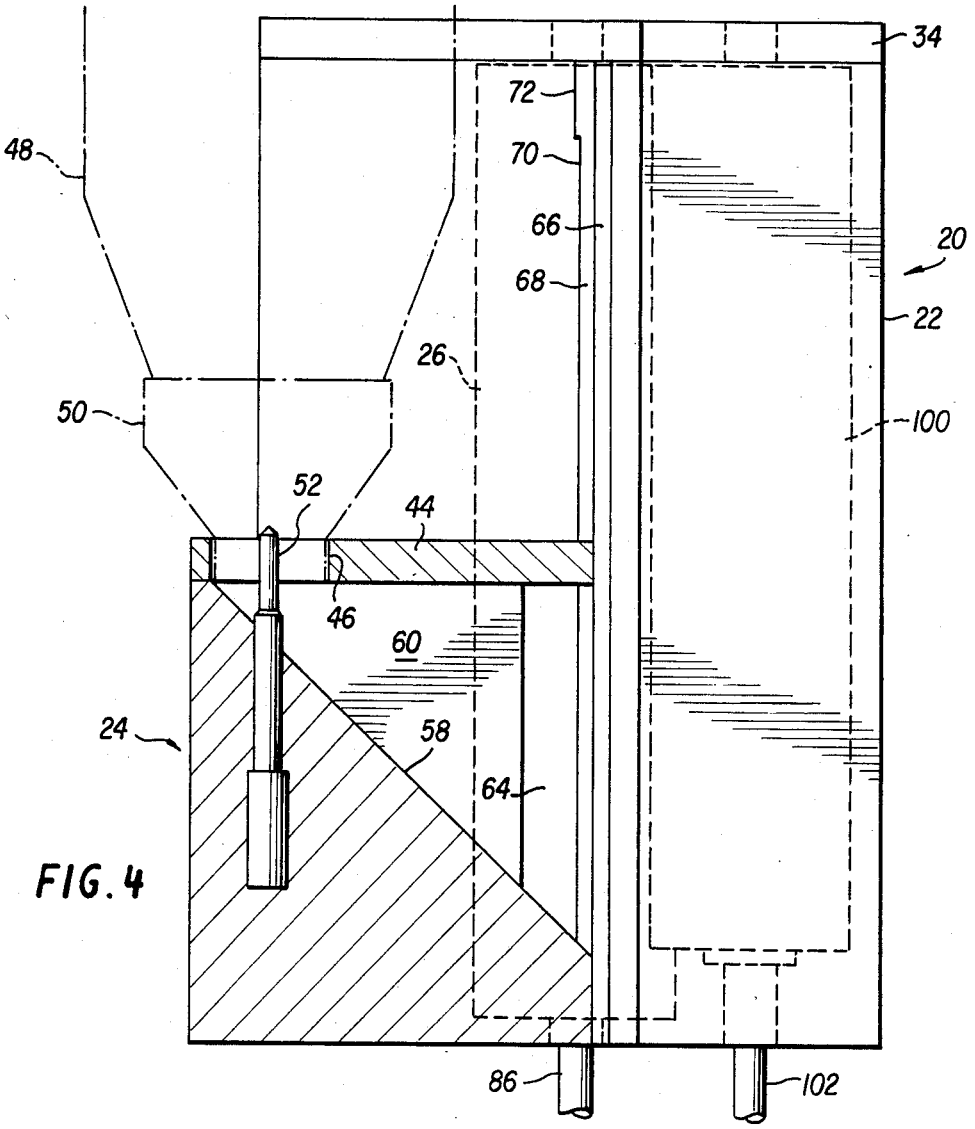
FIG. 4 is a sectional view taken along the line 4—4 in FIG. 3, illustrating the interior of the developer supply hopper, with the lower part of the developer supply container shown in phantom.

Referring to FIGS. 3 and 4, the developer supply hopper 24 will be seen to comprise an enclosure with vertical side walls 57 and 59 and a pair of inclined bottom surfaces 58 and 60. As best seen in FIG. 3, in which the hopper cover 44 of FIG. 4 has been removed, the inclined bottom surfaces 58 and 60 meet along a line of intersection 62. The line of intersection 62 slopes downwardly and rearwardly in a diagonal manner toward a narrow vertical slot 64 which forms the outlet of the hopper 24. Developer particles delivered from the bottle 48 to the interior of the hopper 24 are guided toward the outlet opening 64 by the force of gravity due to the inclined bottom surfaces 58 and 60. The hopper outlet 64 is positioned so that it communicates with the lower part of the supply roll 26 in order to apply developer particles thereto.

As best seen in FIGS. 1, 3 and 4, a doctor blade 66 made of a non-magnetic material such as brass is affixed to the developer unit housing 22 with its blade portion 68 positioned adjacent to the surface of the supply roll 26. For the major part of its length, the blade portion 68 is separated from the cylindrical side surface of the supply roll 26 by a narrow gap 70 as shown. Preferably, the size of this gap is about 0.038 inch. At its upper end, however, the blade portion 68 terminates in a stepped portion 72 which is in physical contact with the fixed outer shell of the supply roll 26. The stepped portion 72 of the supply roll doctor blade serves as a decoupling element for removing substantially all developer particles from the upper periphery of the supply roll 26 as will be described shortly. During fabrication of the developing unit 20, the stepped portion 72 also facilitates the setting of the gap 70 between the lower part of the blade portion 68 and the surface of the supply roll 26. The part of the blade portion 68 which is separated from the surface of the supply roll by the gap 70 functions to maintain on the surface of the supply roll 26 a regulated layer of developer particles having a maximum predetermined thickness, such thickness being a function of the size of the gap 70. It should be noted that the blade portion 68 and upper stepped portion 72 of the supply roll doctor blade 66 are located approximately at the same radial position with respect to the axis of the supply roll 26 as the outlet opening 64 in the toner hopper 24. As a result of such alignment, excess developer particles which are removed from the supply roll 26 by the blade portion 68 and stepped portion 72 of the supply roll doctor blade 66 are automatically returned to the interior of the hopper 24 by gravity.

From what has been said above, it is apparent that the primary functions of the supply roll doctor blade 66 are to control the maximum thickness of the developer layer on the supply roll 26, and to return excess developer particles to the supply hopper 24. However, it has been found that the supply roll doctor blade 66 performs an additional and unexpected function in the present invention, particularly when the upper stepped portion is provided as in the illustrated embodiment. During initial start-up operation of the developer unit 20, the layer of developer tends to be thicker in the area near the bottom of the supply roll 26 than it is in the area near the top of the supply roll. This condition persists until an appreciable amount of developer has been decoupled from the supply roll surface by the upper stepped portion 72 of the doctor blade 66. The decoupled developer will, of course, fall downwardly along the blade portion 68 under the influence of gravity. However, some of the falling developer is magnetically attracted back to the supply roll 26 in the areas where the developer layer on the supply roll does not completely fill the gap between the blade portion 68 and the surface of the roll. In this way, the thinner areas of the developer layer on the supply roll 26 are automatically and continuously filled in, with the result that the average thickness developer layer is eventually made fairly uniform along the vertical height of the supply roll. This phenomenon may be described as "flooding" of the supply roll with excess developer that has been removed by the upper stepped portion 72 of the doctor blade 66.

During steady-state operation of the developer unit 20, the decoupling and reattachment of the developer material occurs to some extent along the entire length of the supply roll doctor blade, since the developer layer has become thick enough to cause some decoupling along the blade portion 68 as well as at the level of the stepped portion 72. Of course, once steady-state operation is achieved and the average thickness of the developer layer on the supply roll 26 becomes fairly uniform, the amount of falling developer material which is attracted back to the supply roll is reduced and more of the developer is delivered back to the supply hopper 24.

From the foregoing description, it can be seen that the supply roll doctor blade 66 performs the useful function of delivering excess developer material, under the influence of gravity, to areas on the surface of the supply roll 26 where the developer layer is not sufficiently thick. This function is unique to the vertical arrangement of components in the present invention and would not occur in the case of a horizontally positioned roll and doctor blade combination.

The upper stepped portion 72 of the supply roll doctor blade, while advantageous for the reasons given previously, is not believed to be essential to the operation of the present invention and may be omitted if desired. In that event, the gradual upward movement of developer particles along the length of the supply roll 26 will eventually result in a local thickening or "mushrooming" of the developer near the top of the roll. The greater thickness of the developer layer in this area will cause the outermost particles of developer to decouple from the supply roll, since these particles will experience a reduced magnetic field strength relative to the field strength at the surface of the supply roll. The decoupled particles of developer will then fall downwardly along the supply roll doctor blade 66, eventually being returned to the supply hopper 24 or attracted back to the supply roll surface as described previously.

In FIG. 2, the developer unit 20 is shown in a rear perspective view with the top cover 34 of FIG. 1 removed and a portion of the rear cover 32 cut away. A second doctor blade 74, a portion of which can be seen in solid outline in FIG. 2, is affixed to the developer unit housing 22 with its blade portion 76 positioned adjacent to the outer shell of the developer roll 28 and separated therefrom by a narrow gap. Preferably, the size of this gap is about 0.015 inch. Unlike the supply roll doctor blade 66, the blade portion 76 of the developer roll doctor blade 74 is uniform along its vertical length and does not contact the outer shell of the developer roll 26 at any point. The developer roll doctor blade 74 functions to maintain on the surface of the developer roll 28 a regulated layer of developer particles having a maximum predetermined thickness, such thickness being a function of the size of the gap between the doctor blade 74 and the developer roll surface. Referring to FIG. 3, it can be seen that the blade portion 76 of the developer roll doctor blade 74 is located in proximity to the narrow vertical gap 58 which separates the developer roll 28 from the supply roll 26. In this way, excess developer particles which are removed from the surface of the developer roll 28 by the doctor blade 74 are magnetically attracted back to the surface of the supply roll 26.

As in the case of the supply roll doctor blade, the developer roll doctor blade 74 performs a "flooding" function during start-up operation of the developer unit 20 and to some extent during steady-state operation as well. That is, to the extent that developer particles removed from the developer roll 28 by the doctor blade 74 are not transferred back to the supply roll 26, these particles will fall downwardly along the blade edge and will be magnetically attracted back to the developer roll in areas where the developer layer is not sufficiently thick. Again, it should be noted that this function of the developer roll doctor blade is unique to the vertical arrangement of components in the present invention and would not occur in the case of a horizontally positioned roll and doctor blade combination.

Referring again to FIG. 2, it can be seen that the developer unit housing 22 is provided with a rear opening 78 which exposes a portion of the developer roll 28 along its entire vertical length. This provides a developing zone wherein the layer of developer particles maintained on the outside circumference of the developer roll 28 can be brought into brushing contact with the surface of a recording medium on which a latent image is to be developed. The recording medium may comprise, for example, a web 80 which is positioned in a vertical plane and moved in a horizontal direction as shown. Alternatively, the recording medium may comprise the peripheral surface of a cylindrical drum which has its axis of rotation extending vertically. The edge portion 82 of the rear cover 32 is angled outwardly where it adjoins the rear opening 78 in the developer unit housing, as shown, to limit the size of the opening 78 and to provide a shield for containing developer particles which may dislodge from the developer roll 28.

Figure 5:
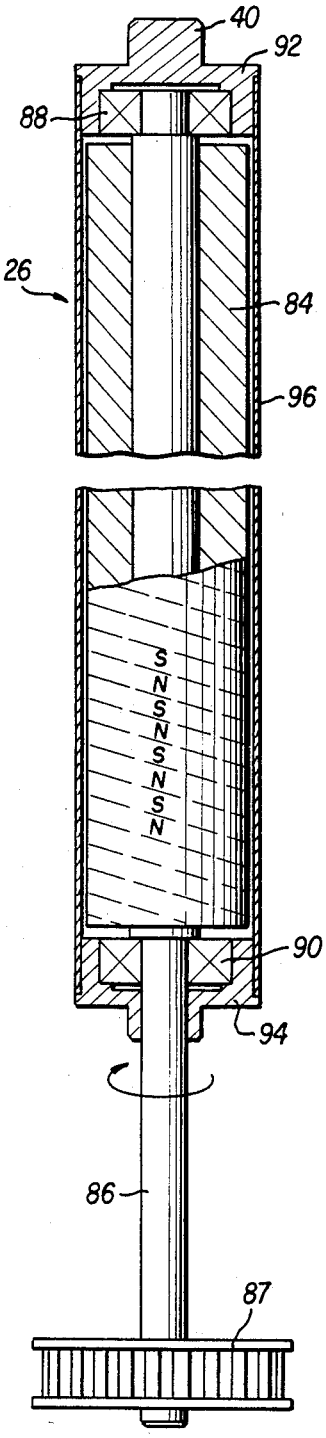
FIG. 5 is a sectional view of a preferred type of magnetic supply roll which can be employed in the present invention.

The detailed construction of the preferred type of supply roll 26 and developer roll 28 will now be described with reference to FIGS. 5 and 6, respectively. The supply roll, shown in FIG. 5, comprises a cylindrical or roll-shaped magnetic element 84 which is affixed to and rotated by a vertical shaft 86. The shaft 86 is journalled for rotation in upper and lower radial ball bearing units 88 and 90 which are mounted in upper and lower end caps 92 and 94, respectively. The upper end cap 92 includes a projecting boss 40 which is received in the hole 36 in the top cover 34 of the developing unit 20 as shown in FIG. 1. The inner magnetic element 84 is completely enclosed by a close-fitting non-magnetic shell 96, preferably made of aluminum or non-magnetic stainless steel, which is cylindrical in shape. The inner magnetic roll 84 is magnetized in a manner such that the alternating magnetic poles on the surface thereof form helical bands with respect to the axis of the roll, as shown. The shaft 86 extends downwardly through the lower end cap 94 and is rotated in the direction shown by a suitable drive means such as an electric motor. To this end, a timing belt pulley 87 is affixed to the lower part of the shaft 86 as illustrated. In a preferred embodiment, the magnet roll 84 within the supply roll 26 has a left screw magnetization pattern with a helix angle of approximately 60° with respect to the roll axis. The magnetic flux density on the surface of the shell 96 is preferably about 400 gauss. A preferred operating speed for the magnet roll 84 within the supply roll 26 is about 1000 RPM.

Figure 6:
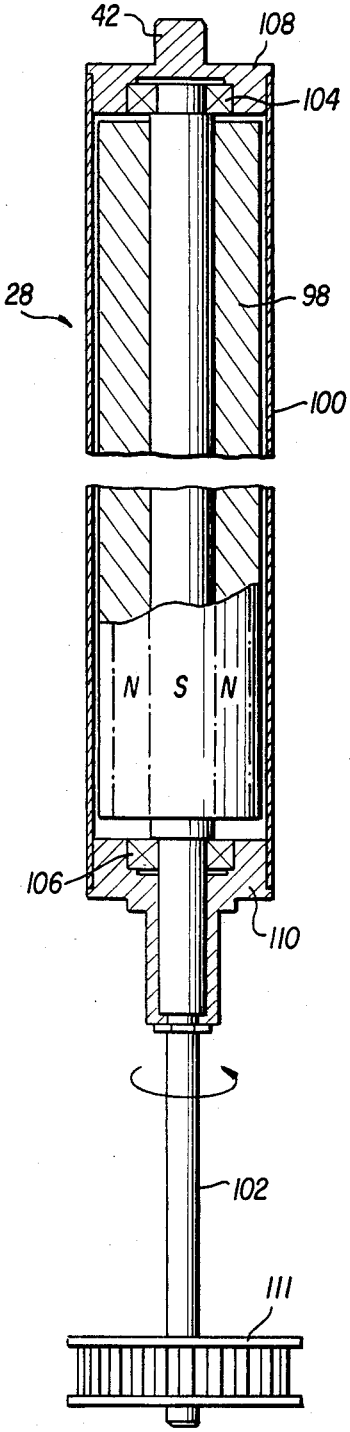
FIG. 6 is a sectional view of a preferred type of magnetic developer roll which can be employed in the present invention.

The developer roll 28 of FIG. 6 is similar in construction, comprising a cylindrical or roll-shaped magnetic element 98 enclosed within a close-fitting non-magnetic shell 100. The developer roll 28 is slightly shorter in length than the supply roll 26 for a reason which will shortly become apparent. The shell 100 of the developer roll is cylindrical in shape and is preferably made of aluminum or non-magnetic stainless steel with a thin polyester coating. The inner magnet roll 98 is affixed to and rotated by a vertical shaft 102. The shaft 102 is journalled for rotation in upper and lower radial ball bearing units 104 and 106 which are embedded in upper and lower end caps 108 and 110, respectively. The upper end cap 108 includes a projecting boss which is received in the hole 38 in the top cover 34 of the developing unit 20 as shown in FIG. 1. The lower part of the shaft 102 extends through the lower end cap 110 and is rotated in the direction indicated by suitable drive means (not shown). In the case of the developer roll 28, the inner magnet roll 98 is provided with a symmetric magnetization pattern in which the alternating magnetic poles are in the form of straight linear bands extending parallel to the roll axis, as shown. In a preferred embodiment, the inner magnetic roll 98 is provided with 8 magnetic poles spaced evenly around the roll circumference. The inner roll 98 produces a magnetic flux density on the surface of the shell 100 of about 700±50 gauss, with a maximum longitudinal variation of 60 gauss. A preferred operating speed for the magnet roll 98 within the developer roll 28 is about 1200 RPM. The lower end of the shaft 102 is preferably fitted with a timing belt pulley 111, as shown, to allow the magnetic element 98 to be rotated by means of an electric motor or other suitable drive means. A double-sided timing belt (not shown) can be attached in a "crossed" manner between the pulleys 87 and 111 to drive the shafts 86 and 102 in the directions indicated. The desired speed ratio is obtained by providing the pulley 87 with a total of 18 teeth and the pulley 111 with a total of 15 teeth.

Figure 7:
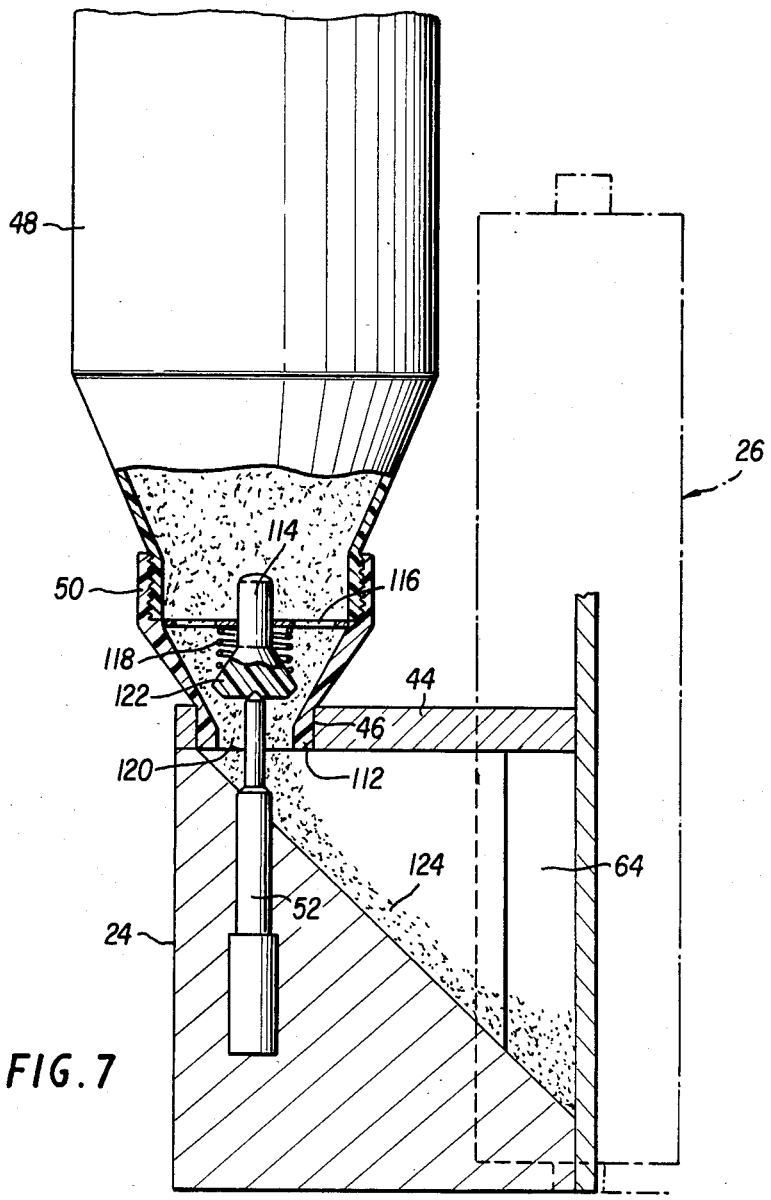
FIG. 7 is a sectional view similar to that of FIG. 4, illustrating the operation of a preferred type of developer dispensing mechanism which can be employed in the present invention.
Figure 8:
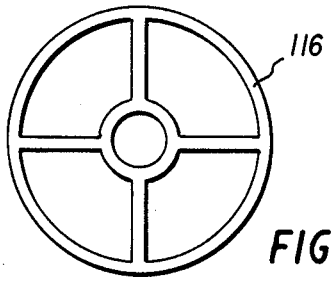
FIG. 8 is a top view of a spoked locating ring which forms a part of the developer dispersing mechanism shown in FIG. 7.

FIG. 7 illustrates the operation of a preferred type of developer dispensing mechanism which can be used in the present invention. The mouth of the inverted developer supply bottle 48 is provided with a threadably attached dispenser cap 50, the latter having a collar portion 112 which is snugly received in the inlet opening 46 of the hopper cover 44. A closure device in the form of a plunger 114 with an enlarged lower portion 122 is positioned centrally within the dispenser cap 50 by means of a spoked locating ring 116. The locating ring 116 is shown in more detail in the top view of FIG. 8. A compression spring 118 disposed between the locating ring 116 and the enlarged lower portion 122 of the plunger 114 normally serves to maintain the plunger in a blocking position within the opening 120 of the dispenser cap. However, when the developer supply bottle 48 is fitted to the inlet opening 46 of the hopper cover 44 as illustrated in FIG. 7, the fixed vertical pin 52 engages the enlarged lower portion 122 of the plunger 114, causing the plunger to move into a non-blocking position with respect to the dispenser cap opening 120. This allows the particulate developer material 124 to flow from the bottle 48 into the hopper 24 as shown, eventually reaching the hopper outlet 64 and the lower portion of the supply roll 26. This arrangement allows the developer supply bottle 48 to be conveniently installed without spillage of the particulate developer material, since the pin 52 does not move the plunger 114 into its non-blocking position until the collar 112 of the dispenser cap is engaged with the hopper inlet opening 46. When the supply of developer in the bottle 48 has been depleted, the bottle can be removed and refilled or replaced with a full bottle. The dispenser cap 50 may be provided as a removable part of the developer unit 20 and simply substituted for the conventional screw cap on the toner bottle 48 when a replacement bottle of developer is required. Alternatively, the cap 50 may be provided as part of the replacement bottle of developer.

If necessary, the developer dispensing function can be enhanced by enlarging the opening in the dispensing cap 50, or by providing a discharge assistant such as a rotary impeller or an intermittent vibratory feed mechanism. The spill pin 52 may be used as the drive means for the rotary impeller or as the vibrating element in a vibratory feed system.

Figure 10:
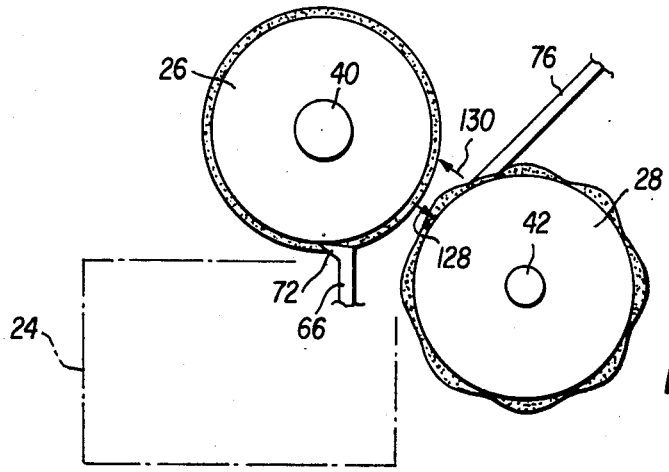
FIG. 10 is a top view of the supply and developer rolls of FIG. 9, also illustrating the layer of developer material carried by each roll.
Figure 9:
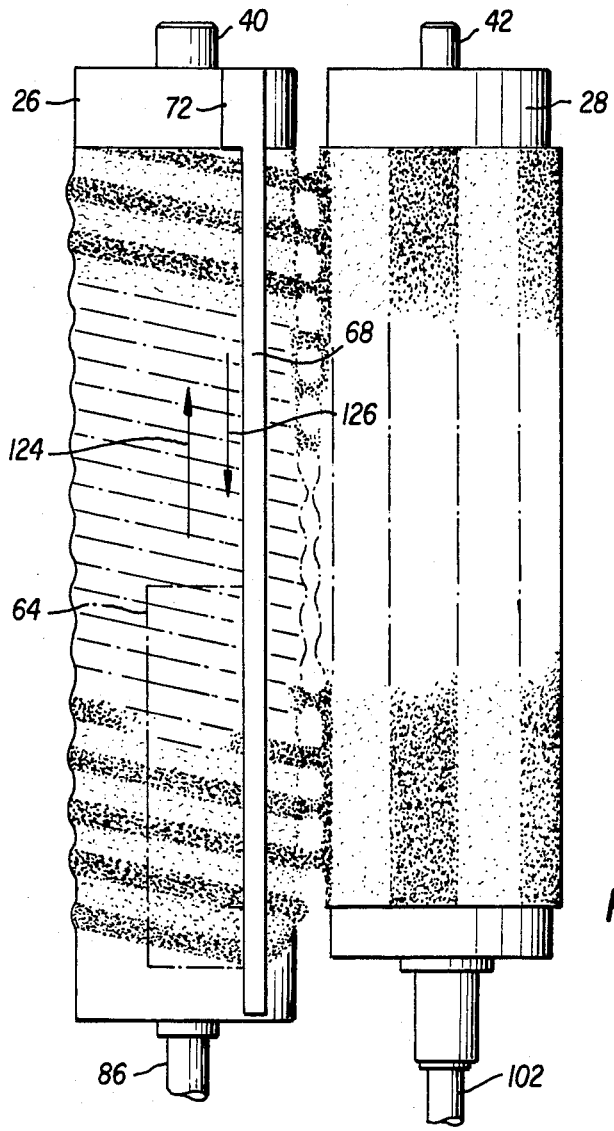
FIG. 9 is an elevational view illustrating the magnetic supply and developer rolls removed from the developing apparatus, with a layer of developer material shown on the outside surface of each roll.

The operation of the vertical magnetic brush developing unit 20 will now be described with reference to FIGS. 1–8, previously discussed, and also with reference to FIGS. 9–10 in which the developer layers on the supply and developer rolls are shown. Developer particles supplied from the bottle 48 to the hopper 24 are applied to the lower portion of the supply roll 26 through the hopper outlet 64. When the inner magnetic element 84 of the supply roll 26 is rotated in the direction shown in FIG. 5, the helical magnetization pattern of the magnetic element causes the developer particles to move both circumferentially and vertically upward along the surface of the supply roll shell. This causes a substantially continuous layer of toner particles to be maintained on the supply roll, although the developer layer will form slightly thicker bands or tufts along the helical magnetic poles as illustrated in FIG. 9. The supply roll doctor blade 66 functions to limit the developer layer on the supply roll 26 to a maximum predetermined thickness, with excess developer particles being returned by gravity to the hopper 24 or to the lower part of the supply roll as described earlier. The upper stepped portion 72 of the supply roll doctor blade 66 operates to remove substantially all developer particles from the upper portion of the supply roll 26. This insures that the developer particles do not advance beyond a predetermined vertical height on the surface of the supply roll 26, and thereby prevents the overflow of developer from the upper part of the supply roll. The supply roll doctor blade 66 thus completes what may be described as a first developer recirculation loop between the supply roll and the hopper, and vice-versa. The upward movement of developer in the loop, indicated by the arrow 124 in FIG. 9, is by virtue of the helically magnetized supply roll 26. The downward movement of developer back to the hopper 24, indicated by the arrow 126, is carried out by gravity.

Due to the greater magnetic field strength of the developer roll 28 relative to that of the supply roll 26, developer particles are induced to transfer from the supply roll to the developer roll across the narrow vertical gap 58 which separates the two rolls. This transfer of the developer particles is indicated by the arrow 128 in FIG. 10. The transfer of developer particles occurs at the points where the helical bands or tufts of developer on the supply roll intersect the developer roll, as may be appreciated from FIG. 9. Also in FIG. 9, it may be seen that the supply roll 26 is somewhat longer than the developer roll 28, and that the developer roll is offset vertically with respect to the supply roll. This is to insure that developer particles are transferred from the supply roll 26 to the developer roll 28 along the entire magnetized length of the developer roll. The developer particles so transferred will distribute themselves around the circumference of the developer roll 28 when the inner magnetic element 98 of the developer roll is rotated in the direction shown in FIG. 6. As in the case of the supply roll, the developer material will form slightly thicker bands or tufts along the magnetic poles of the developer roll 28, although in this case the bands are vertical rather than helical. The alternating magnetic bands on the magnetic element 98 within the developer roll cause a backward tumbling or somersaulting of the developer particles on the developer roll shell 100, resulting in a net movement of the developer layer in a direction opposite to the direction of rotation of the inner magnetic element 98. The direction of developer movement on the shell of the developer roll 28 is indicated by the arrow 29 in FIGS. 1 and 3. Similarly, the direction of developer movement on the outer shell of the supply roll 26 is indicated by the arrow 27 in FIGS. 1 and 3. The developer roll doctor blade 74 controls the maximum thickness of the developer layer on the developer roll 28. Also, since the blade portion 76 of the developer roll doctor blade 74 is positioned in proximity to the gap 58 separating the developer roll from the supply roll 26, excess developer which is removed from the developer roll 28 by the blade portion 76 is magnetically attracted back to the surface of the supply roll 26. Such movement of the developer particles is indicated by the arrow 130 in FIG. 10. The developer roll doctor blade 74 therefore completes a second developer recirculation loop between the supply roll 26 and the developer roll 28, and vice-versa. To the extent that developer particles which are removed from the developer roll 28 by the doctor blade 74 are not returned to the supply roll 26, such particles fall downwardly along the blade edge and are attracted back to the developer roll to fill in any thin areas in the developer layer on that roll as described previously.

As a result of the first and second developer recirculation loops, there is a continuous interchange of developer material between the hopper 24 and the supply roll 26, as well as between the supply roll 26 and the developer roll 28. Excess developer which is removed from either the supply roll 26 or the developer roll 28 is eventually returned to the hopper 24. In operation, the developer layer on the developer roll 28 is placed in light brushing contact with a moving recording surface on which a latent image has been formed. During a given time interval, the amount of developer delivered to the recording medium will be equal to the net amount of developer removed from the hopper 24. In situations where the recording medium moves at a slow rate of speed, there is no tendency for an excessive amount of developer to be delivered to the recording medium. If the recording medium is stopped or removed entirely, the developer particles simply recirculate between the hopper 24 and the supply and developer rolls 26 and 28, without any tendency to overflow the top of either roll.

The developer unit 20 of the present invention has been found to operate satisfactorily with Hitachi HMT-605 magnetic single-component toner, which is available from Hitachi Metals, Ltd. However, the choice of a particular type of toner is not believed to be critical, and it is anticipated that other types of single-component and two-component toners will be usable in connection with the invention.

In general, the invention is applicable in any situation where the recording surface to be developed has its lateral or transverse dimension (i.e., the dimension perpendicular to its direction of movement) extending in a vertical direction. This might occur in the case of a drum-type recording member when the drum has its axis of rotation disposed vertically, or in the case where the recording medium comprises a web, sheet or endless belt which is held in a vertical plane and moved in a horizontal direction. The invention is usable in connection with any type of eletrostatic or xerographic recording process, including processes employing photosensitive recording members as well as those employing non-photosensitive dielectric recording members. In addition to latent electrostatic images, latent magnetic images can also be developed.

Although the present invention has been described with reference to a preferred embodiment, it should be understood that the invention is not limited to the details thereof. All dimensions, material specifications, operating speeds, and other details of construction or operation, are given by way of example only and are not intended to limit the scope of the invention. A number of possible substitutions and modifications have been suggested in the foregoing detailed description, and others will occur to those of ordinary skill in the art. All such substitutions and modifications are intended to fall within the scope of the invention as defined in the appended claims.

What is claimed is:

1. A vertically positioned magnetic brush developing apparatus for applying magnetically attractable developer particles to a latent electrostatic or magnetic image on a vertically presented recording surface, said apparatus comprising:

(a) a hopper for containing a supply of developer particles and having an outlet;

(b) a first magnetic roll assembly, serving as a supply roll, having its axis aligned in a substantially vertical direction and having its lower portion in communication with the hopper outlet for receiving developer particles therefrom, said supply roll comprising an inner magnetic element having a helical magnetic pole pattern and an outer non-magnetic shell surrounding said inner magnetic element for carrying the developer particles, at least one of said inner magnetic element and said outer shell being rotatable relative to the other about the axis of the supply roll for causing developer particles to move both circumferentially around the supply roll and upwardly along the vertical length of the supply roll, to thereby form a substantially continuous layer of developer particles on the outside surface of the supply roll;

(c) a supply roll doctor blade positioned adjacent to the outer shell of the supply roll and forming a narrow gap therewith in order to maintain on the supply roll shell a regulated layer of developer particles having a predetermined maximum thickness;

(d) a second rotatable magnetic roll assembly, serving as a developer roll, arranged in side-by-side relationship with the supply roll with a narrow vertical gap therebetween and having its axis aligned with the axis of the supply roll, said developer roll comprising an inner magnetic element having a magnetic pole pattern in which the magnetic poles are arranged in straight linear bands parallel to the roll axis and an outer non-magnetic shell surrounding said inner magnetic element for carrying the developer particles, at least one of said inner magnetic element and said outer shell being rotatable relative to the other about the axis of the developer roll for causing developer particles to move circumferentially around the developer roll, said developer roll being positioned sufficiently close to the supply roll and having a magnetic field strength sufficiently greater than that of the supply roll to cause developer particles on the outer shell of the supply roll to transfer to the outer shell of the developer roll, with the magnetic pole pattern of the developer roll thereupon causing the developer particles to move circumferentially around the developer roll in a substantially continuous layer; and (e) a developer roll doctor blade positioned adjacent to the outer shell of the developer roll and forming a narrow gap therewith in order to maintain on the developer roll shell a regulated layer of developer particles having a predetermined maximum thickness.

2. A vertically positioned magnetic brush developing apparatus as claimed in claim 1, wherein the outer non-magnetic shells of the supply roll and developer roll are each fixed, and wherein the inner magnetic elements of the supply roll and developer roll are each rotatably mounted.

3. A vertically positioned magnetic brush developing apparatus as claimed in claim 1, wherein the supply roll doctor blade is positioned in substantial alignment with the hopper outlet in order to return excess developer particles from the supply roll to the hopper by gravity.

4. A vertically positioned magnetic brush developing apparatus as claimed in claim 3, wherein the outer shell of the supply roll is fixed, and wherein the supply roll doctor blade terminates in an upper stepped portion which is in contact with the upper part of the supply roll shell, said stepped portion serving as a decoupling element for removing substantially all developer particles from the upper part of the supply roll and for returning the developer particles so removed to the hopper by gravity.

5. A vertically positioned magnetic brush developing apparatus as claimed in claim 3, wherein the developer roll doctor blade is positioned in proximity to the gap between the supply roll and the developer roll in order to return excess developer particles from the developer roll to the supply roll by magnetic attraction.

6. A vertically positioned magnetic brush developing apparatus as claimed in claim 1, wherein the hopper comprises an enclosure having at least one inclined bottom surface for directing developer particles toward the hopper outlet.

7. A vertically positioned magnetic brush developing apparatus as claimed in claim 1, wherein the hopper comprises an enclosure having two inclined bottom surfaces joined along a line of intersection with said line of intersection sloping downwardly toward the hopper outlet, and wherein said hopper outlet comprises a narrow vertical slot positioned in proximity to the lower portion of the supply roll.

8. A vertically positioned magnetic brush developing apparatus as claimed in claim 7, further comprising a removable developer container for continuously supplying developer particles to the hopper, said developer container being held in an inverted position with the mouth of said container fitted to an inlet opening at the top of the hopper.

9. A vertically positioned magnetic brush developing apparatus as claimed in claim 8, wherein the developer container includes closure means for automatically opening the mouth of said container in order to start the flow of developer into the hopper when the mouth of the container is fitted to the inlet opening of the hopper, and for automatically closing the mouth of the container to stop the flow of developer when said container is removed from the inlet opening of the hopper.

10. A vertically positioned magnetic brush developing apparatus as claimed in claim 9, wherein said automatic closure means comprises a spring-loaded plunger positioned within the mouth of the developer container, said plunger normally occupying a blocking position in the mouth of said container, and wherein the hopper is fitted with a vertical pin aligned with the inlet opening thereof for moving said plunger into a non-blocking position when the mouth of the developer container is fitted to the inlet opening.

11. A method for applying magnetically attractable developer particles to a latent electrostatic or magnetic latent image on a vertically presented recording surface, comprising:

(a) supplying magnetically attractable developer particles to the lower portion of a vertically positioned magnetic supply roll;

(b) causing the developer particles to move both circumferentially around the supply roll and upwardly along the vertical length of the supply roll to form a substantially continuous layer of developer particles in the supply roll;

(c) magnetically transferring developer particles from the supply roll to a vertically positioned magnetic developer roll separated from the supply roll by a narrow vertical gap;

(d) causing the developer particles so transferred to move circumferentially around the developer roll in a substantially continuous layer; and (e) bringing the layer of developer particles on the developer roll into contact with a vertically presented recording surface carrying a latent electrostatic or magnetic image.

12. The method of claim 11, comprising the further step of moving the recording surface in a horizontal direction while the layer of developer particles on the developer roll is maintained in contact with the recording surface.

13. The method of claim 11, comprising the further steps of:

(f) doctoring said supply roll to maintain thereon a regulated layer of developer particles having a predetermined maximum thickness; and (g) returning excess developer particles which are removed from the supply roll in step (f) to a supply hopper.

14. The method of claim 11, comprising the further steps of:

(f) doctoring said developer roll to maintain thereon a regulated layer of developer particles having a maximum predetermined thickness; and (g) returning excess developer particles which are removed from the developer roll in step (f) to the supply roll.

* * * * *